US007377124B2

(12) United States Patent
Kim et al.

(10) Patent No.: US 7,377,124 B2
(45) Date of Patent: May 27, 2008

(54) REFRIGERATOR

(75) Inventors: Moo Youl Kim, Seoul (KR); Sang Ho Seo, Gwangmyeong-si (KR); Dong Hoon Lee, Incheon-si (KR); Young Hoon Yun, Daegu-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/815,700

(22) Filed: Apr. 2, 2004

(65) Prior Publication Data

US 2005/0217307 A1 Oct. 6, 2005

(51) Int. Cl.
*F25D 17/04* (2006.01)

(52) U.S. Cl. ..... 62/408; 62/413

(58) Field of Classification Search ..... 62/404, 62/407, 408, 411, 413, 414, 419, 186, 187, 62/442, 441, 446, 447; 454/186, 236, 347
See application file for complete search history.

(56) References Cited

U.S. PATENT DOCUMENTS 2,387,622 A * 10/1945 Tanner ..... 62/414
2,442,882 A * 6/1948 Tull et al. ..... 62/414
3,122,005 A * 2/1964 Costantini et al. ..... 62/419
3,495,416 A * 2/1970 Morrisse, Jr. et al. ..... 62/155
3,976,122 A * 8/1976 Neidhardt ..... 165/265
4,058,989 A * 11/1977 Horvay et al. ..... 62/256
4,638,644 A * 1/1987 Gidseg ..... 62/329
4,722,200 A * 2/1988 Frohbieter ..... 62/382
4,914,928 A * 4/1990 Fellwock et al. ..... 62/408
4,924,680 A * 5/1990 Janke et al. ..... 62/187
5,355,686 A * 10/1994 Weiss ..... 62/89
5,490,395 A * 2/1996 Williams et al. ..... 62/187
6,055,820 A * 5/2000 Jeong et al. ..... 62/186
6,062,037 A * 5/2000 Yoon ..... 62/407
6,199,400 B1 * 3/2001 Banicevic et al. ..... 62/408
6,990,828 B2 * 1/2006 Kim et al. ..... 62/381

FOREIGN PATENT DOCUMENTS

JP 2003-161568 A * 6/2003

* cited by examiner

*Primary Examiner*—Mohammad M Ali
(74) *Attorney, Agent, or Firm*—Greenblum & Bernstein, P.L.C.

(57) ABSTRACT

Disclosed is a refrigerator with a freezing chamber and a cooling chamber, in which an evaporating unit is provided in a means for partitioning between the freezing chamber and the cooling chamber. The refrigerator comprises of freezing and cooling chambers, each of the freezing and cooling chambers being provided with at least one received space; an evaporator; and a means for transmitting and controlling a cooling air heat-exchanged with the evaporator toward at least one place in the freezing and cooling chambers, wherein a means for partitioning the freezing and cooling chambers from each other has a predetermined space therein, the predetermined space is provided with the evaporator and at least one means for transmitting and controlling the cooling air.

19 Claims, 7 Drawing Sheets

REFRIGERATOR

BACKGROUND OF THE INVENTION

1) Field of the Invention

The invention relates to a refrigerator constituting a freezing chamber and a cooling chamber, in which an evaporating unit is provided in a means for partitioning between the freezing chamber and the cooling chamber.

2) Description of the Related Art

A conventional refrigerator is generally configured of two chambers, a freezing chamber and a cooling chamber, which are vertically separated from each other. A current refrigerator is gradually changed into a structure capable of opening/closing the freezing and cooling chamber at the front.

FIG. 1 is a block diagram showing a freezing cycle of a general refrigerator.

As shown in FIG. 1, a refrigerant compressed by a compressor 21 enters a condenser 24. The refrigerant passing through the condenser 24 enters a capillary tube 23. The refrigerant passing through the capillary tube 23 enters an evaporator 24 to generate a freezing effect, and then re-enters the compressor 21 to be compressed. This process is repeated.

Here, the compressor 21 changes the gaseous refrigerant of a low-temperature and low-pressure into that of a high-temperature and high-pressure, and discharges the changed result toward the condenser 24. The condenser 24 cools the gaseous refrigerant of the high-temperature and high-pressure into a liquid refrigerant of a middle-temperature and high-pressure by heat radiation, and introduces the cooled result into the capillary tube 23. The liquid refrigerant of the middle-temperature and high-pressure passes through the capillary tube 23 to become a liquid refrigerant of a low-temperature and low-pressure. While passing through the evaporator 22, the liquid refrigerant of the low-temperature and low-pressure takes heat from inside of a main body of the refrigerator, and becomes a gaseous refrigerant of the low-temperature and low-pressure. The gaseous refrigerant of the low-temperature and low-pressure is introduced into the compressor 21 again.

Therefore, this freezing cycle is repeated, so that freezing and cooling effects are generated inside of the refrigerator.

FIG. 2 is a perspective view showing a conventional refrigerator, whose doors are opened.

As shown in FIG. 2, a refrigerator is designed so that a freezing chamber 1 and a cooling chamber 2, both of which are provided a plurality of received spaces, are divided from each other and are opened (or closed) by a door of the refrigerator.

The cooling chamber 2 is used to keep various foods including meat and vegetables which are required not only for maintenance of a degree of freshness at a low temperature, but also for storage for a short time period, as well as beverages for drinking at a low temperature, while the freezing chamber 1 is used to deposit various foods which are required for storage for a long time period at a very low temperature (of about −18° C.).

In order to maintain the freezing chamber 1 at the very low temperature, a cooling air is generated from an evaporator (7 of FIG. 3) performing a freezing cycle, and is supplied through an outlet 5 provided on a rear wall 4 of the freezing chamber 1.

FIG. 3 is a side cross-sectional view showing a conventional refrigerator, in which an evaporator unit is mounted on a rear wall of a freezing chamber, and FIG. 4 is an exploded perspective view showing a structure of the evaporator unit shown in FIG. 3.

A process of discharging a cooling air from an evaporator 7 will be described in more detail. As shown in the figures, a rear wall 4 of a freezing chamber is provided with a shroud 8 as a path for the cooling air. The shroud 8 is provided with the evaporator unit on the rear thereof. The evaporator unit is comprised of an evaporator 7, a blow fan 9 and a cooling air outlet 5. The cooling air generated from the evaporator 7 travels along the cooling air path formed by the shroud 8 while being forcibly circulated by the blow fan 9, and is finally discharged through the cooling air outlet 5 provided at a predetermined position of the rear wall 4 of the freezing chamber.

However, when the evaporator unit is provided on the rear of the shroud 8 located at the rear wall 4 of the freezing chamber, a part of space of the freezing chamber is occupied by the evaporator unit. For this reason, a real efficient volume of the freezing chamber is reduced, so that a user experiences reduced convenience.

In other words, because the above-mentioned evaporator is wide, thick and short, a large extra space exists under the evaporator as a portion "A" of FIG. 3. Nevertheless, the extra space is not used, so that the entire received space of the freezing chamber is not efficiently used.

SUMMARY OF THE INVENTION

Therefore, an objective of the present invention is to maximize usefulness of a refrigerator by disposing an evaporator unit in a space other than a predetermined space of a freezing chamber or a cooling chamber.

Therefore, as one example, it is proposed that the evaporator unit is provided in a compartment which partitions the freezing chamber and the cooling chamber from each other.

In order to accomplish the objective, there is provided a refrigerator comprising: freezing and cooling chambers, each of the freezing and cooling chambers being provided with at least one received space; an evaporator; and a means for transmitting and controlling a cooling air heat-exchanged with the evaporator toward at least one place in the freezing and cooling chambers, wherein a means for partitioning the freezing and cooling chambers from each other has a predetermined space therein, the predetermined space is provided with the evaporator and at least one means for transmitting and controlling the cooling air.

As one example, the refrigerator includes a blow fan as the means for transmitting the cooling air to at least one place in the freezing and cooling chambers.

As another example, the refrigerator includes a cooling air outlet through which the cooling air is discharged by the means for transmitting the cooling air to at least one place in the freezing and cooling chambers.

Therefore, the refrigerator having the evaporator in the compartment for partitioning the freezing chamber and the cooling chamber from each other can increase utility of the refrigerator and convenience of the user compared to that of the same size by maximizing availability of the received space as the efficient volume of the refrigerator.

DETAILED DESCRIPTION OF THE INVENTION

Hereinafter, description will now be made in detail regarding preferred embodiments of refrigerator in which an evaporator unit is provided in a compartment partitioning a freezing chamber and a cooling chamber from each other in accordance with the present invention with reference to the accompanying drawings.

Figure 1:
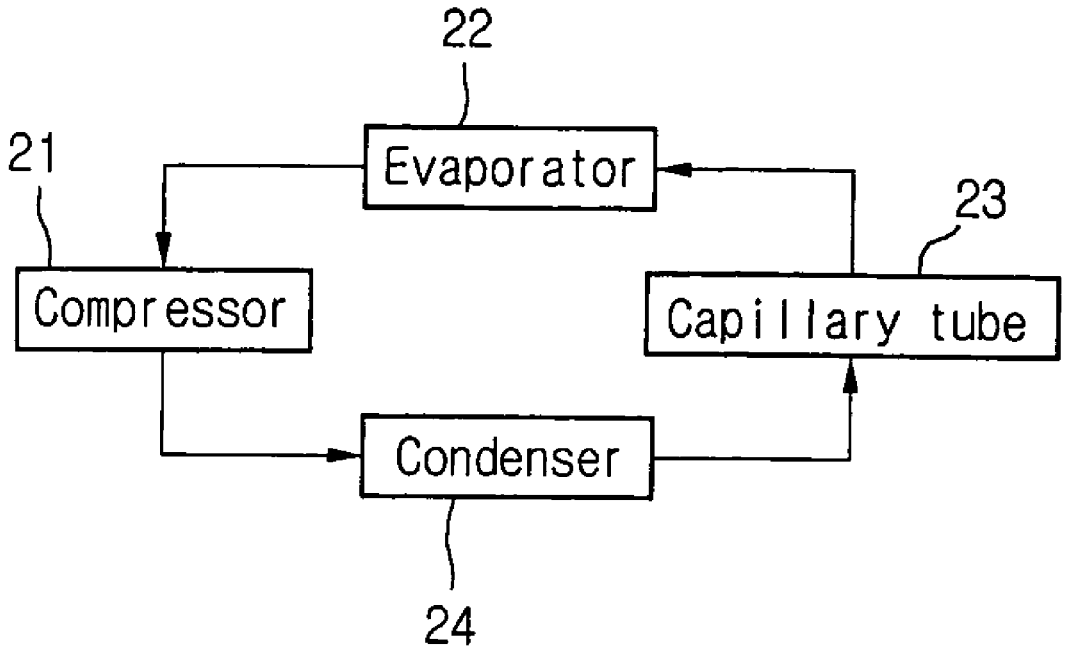
Fig.1 Related Art
FIG. 1 is a block diagram showing a freezing cycle of a general refrigerator.
Figure 2:
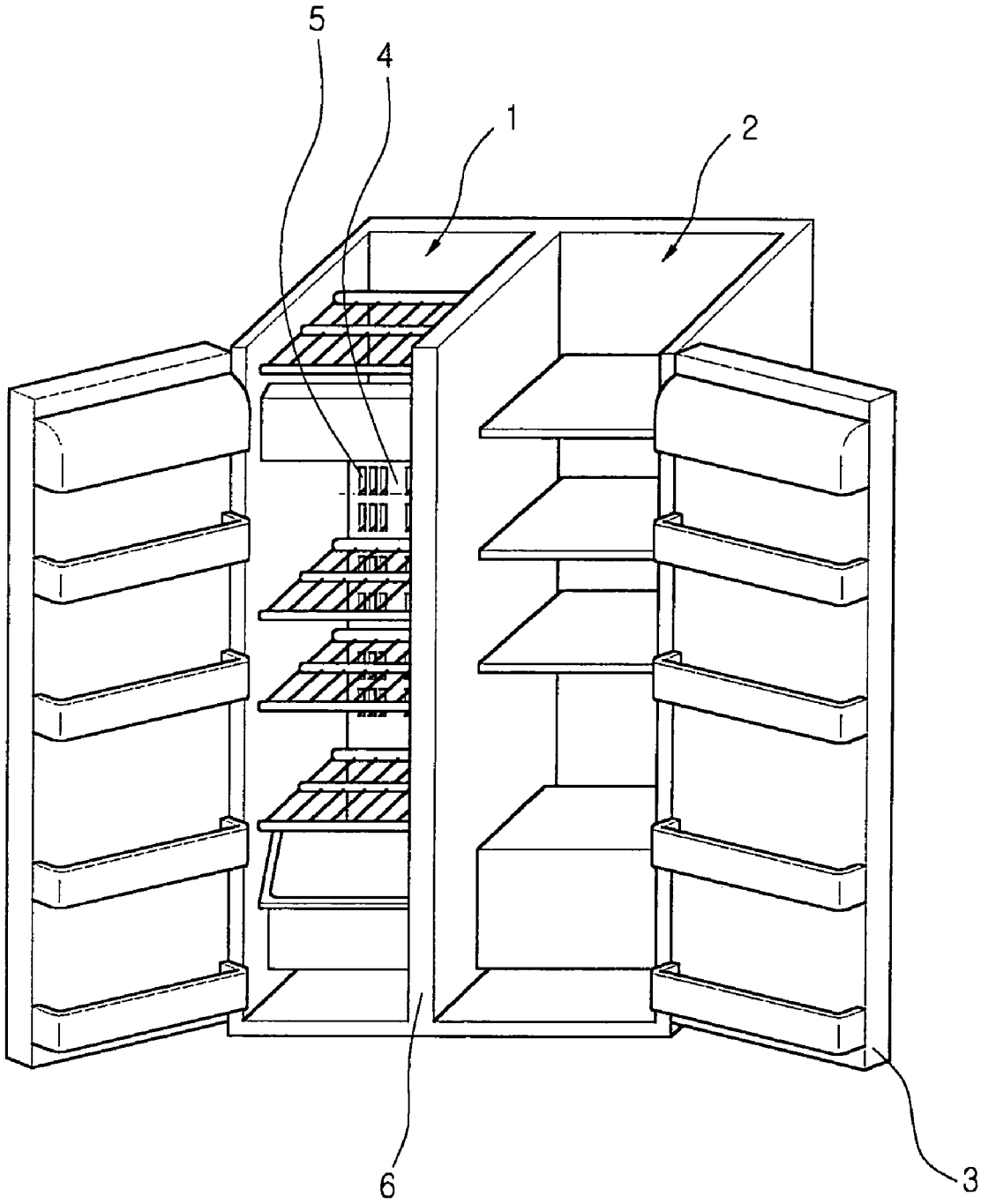
Fig.2 Related Art
FIG. 2 is a perspective view showing a conventional refrigerator, whose doors are opened.
Figure 3:
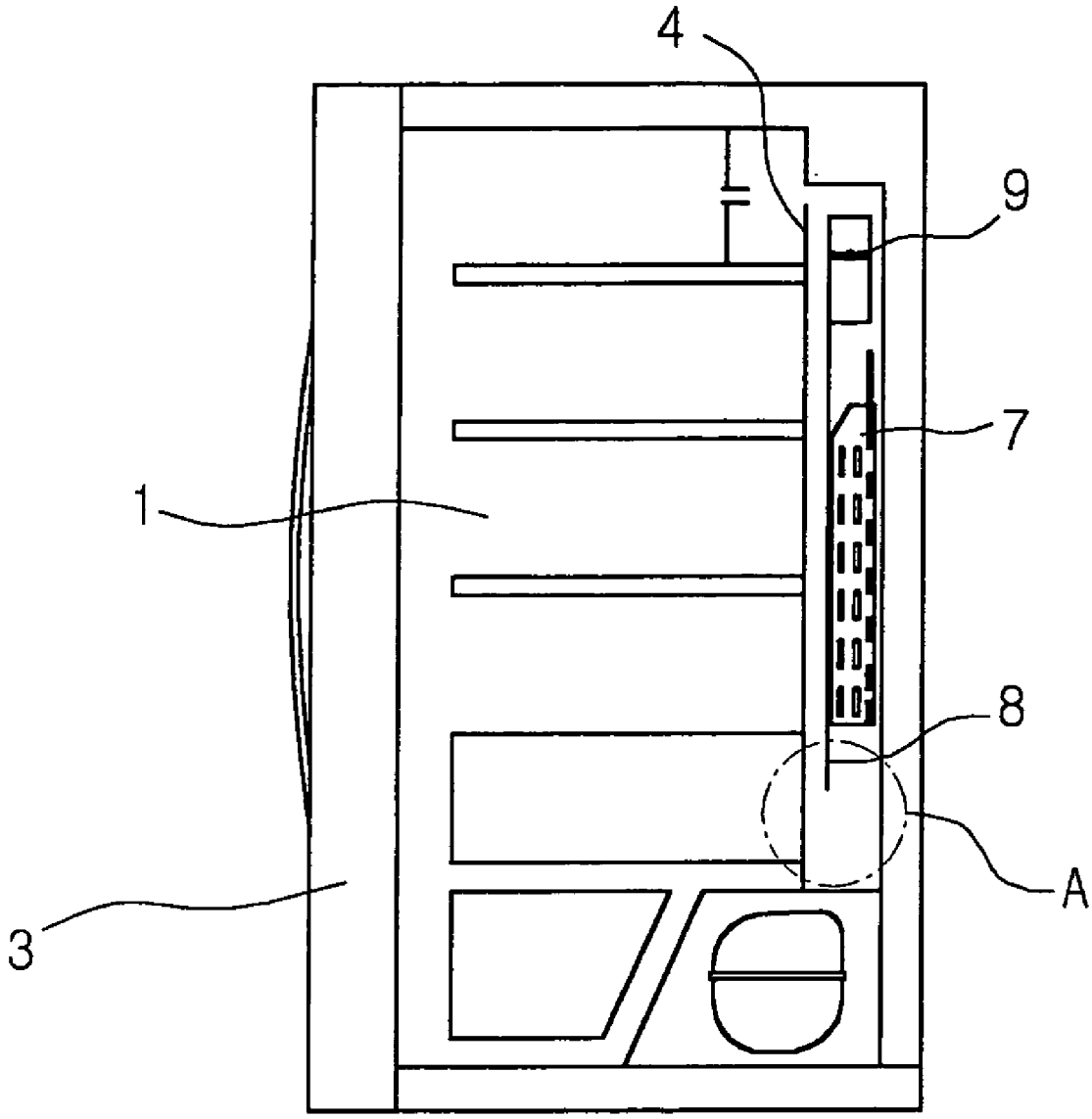
Fig.3 Related Art
FIG. 3 is a side cross-sectional view showing a conventional refrigerator, in which an evaporator unit is mounted on a rear wall of a freezing chamber.
Figure 4:
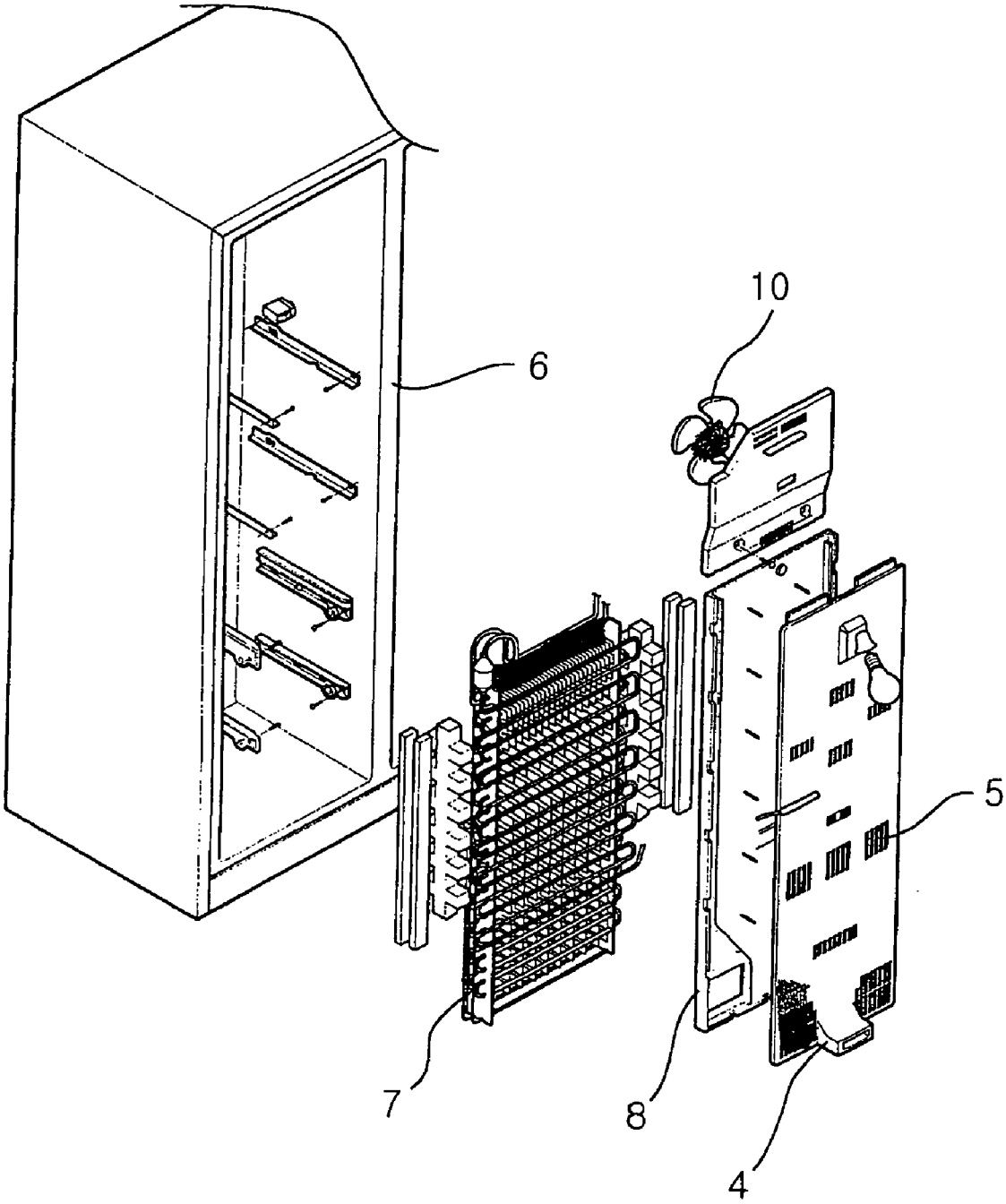
Fig. 4 Related Art
FIG. 4 is an exploded perspective view showing a structure of the evaporator unit shown in FIG. 3.
Figure 5:
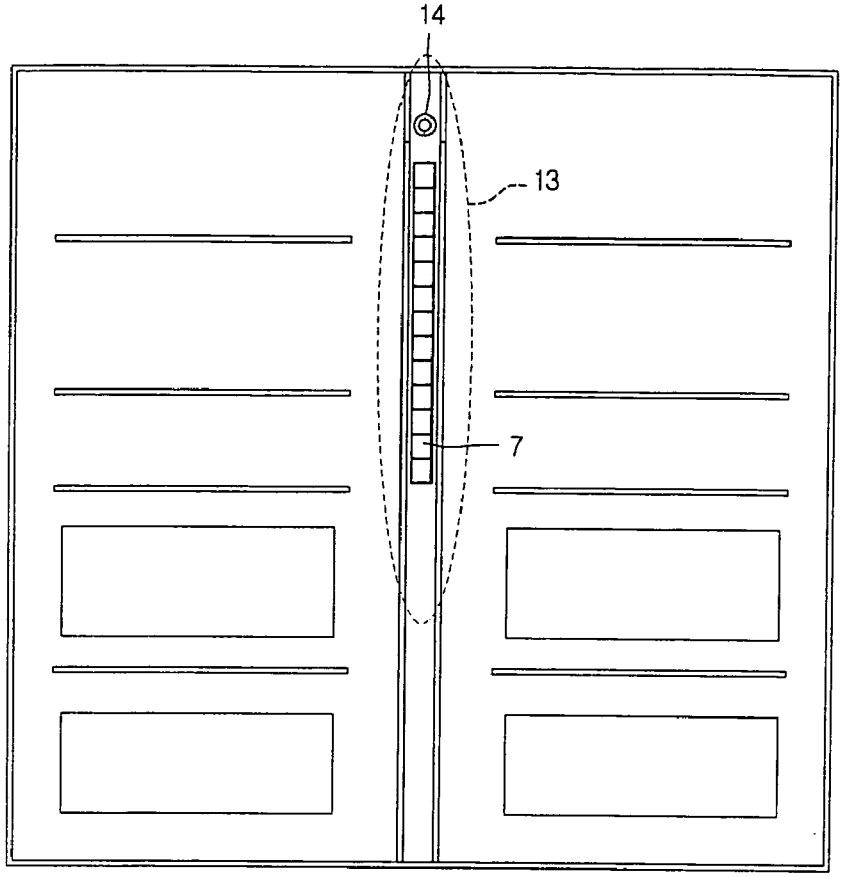
FIG. 5 is a schematic front view showing a configuration where an evaporator unit is provided between a freezing chamber and a cooling chamber in accordance with the present invention.

FIG. 5 is a schematic front view showing a configuration where an evaporator unit is provided between a freezing chamber and a cooling chamber in accordance with the present invention.

As shown in FIG. 5, an evaporator unit 13 is provided in a compartment, a mullion, between a freezing chamber and a cooling chamber. An evaporator 7 is disposed at a certain position of the evaporator unit. A blow fan and a cooling air outlet 14 are provided on an upper or lower portion of the evaporator, and function to transmit or control a cooling air passing through the evaporator to the freezing chamber and/or the cooling chamber.

The freezing chamber and the cooling chamber are generally partitioned and spaced apart from each other by the compartment 6. The compartment 6 has a predetermined thickness. Thus, a certain size of space is formed in the compartment.

Figure 6:
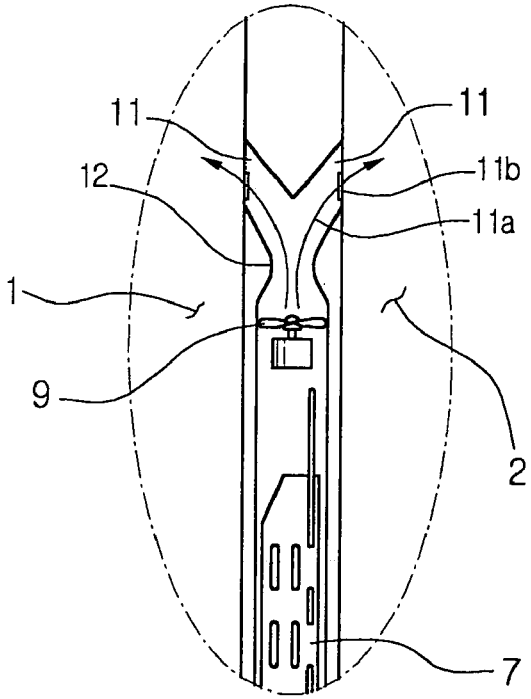
FIG. 6 is a magnified and detailed view showing the evaporator unit of FIG. 5.

FIG. 6 is a magnified and detailed view showing the evaporator unit of FIG. 5.

The evaporator 7 for generating the cooling air is arranged at a certain position of the space formed in the compartment 6, for example on a middle or lower portion of the compartment. The cooling air generated from the evaporator 7 is finally discharged toward the freezing chamber 1 and the cooling chamber 2 through a cooling air outlet 11 provided on one side of the compartment.

In order to smoothly circulate the cooling air, a blow fan 9 for circulating the cooling air by force is preferably mounted between the evaporator 7 and the cooling air outlet 11. The cooling air generated from the evaporator 7 at this time is forcibly circulated by the blow fan 11 and then is discharged toward the cooling air outlet 11.

Meanwhile, in order to accelerate a stream of the cooling air, a predetermined interval of path between side walls defining a passage of the cooling air is narrowed. Thereby, a velocity of the cooling air can be increased.

Further, there is a guide 11*a* for guiding the cooling air forced by the blow fan to be introduced into the freezing and cooling chambers. A means for controlling the cooling air discharged from the cooling air outlet is provided, and for example, a damper unit 11*b* may be provided.

Figure 7:
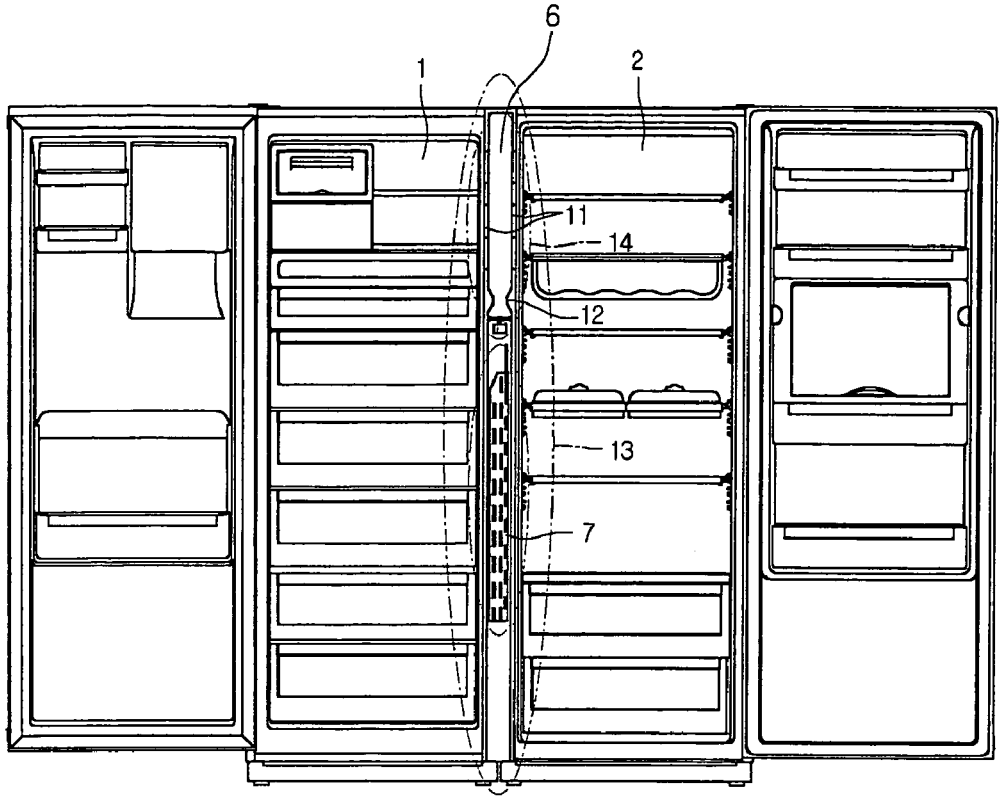
FIG. 7 shows a first embodiment of a refrigerator having the evaporator, the blow fan and the cooling air outlet of FIG. 5.

FIG. 7 shows a first embodiment of a refrigerator having the evaporator, the blow fan and the cooling air outlet of FIG. 5.

The evaporator 7 of the evaporator unit 13 is provided in the space 6 between the freezing chamber 1 and the cooling chamber 2. The means 14, such as the blow fan and the cooling air outlet 11, for guiding and controlling the cooling air passing through the evaporator to the freezing chamber and the cooling chamber is provided The evaporator may be mounted around the middle portion of the compartment.

Figure 8:
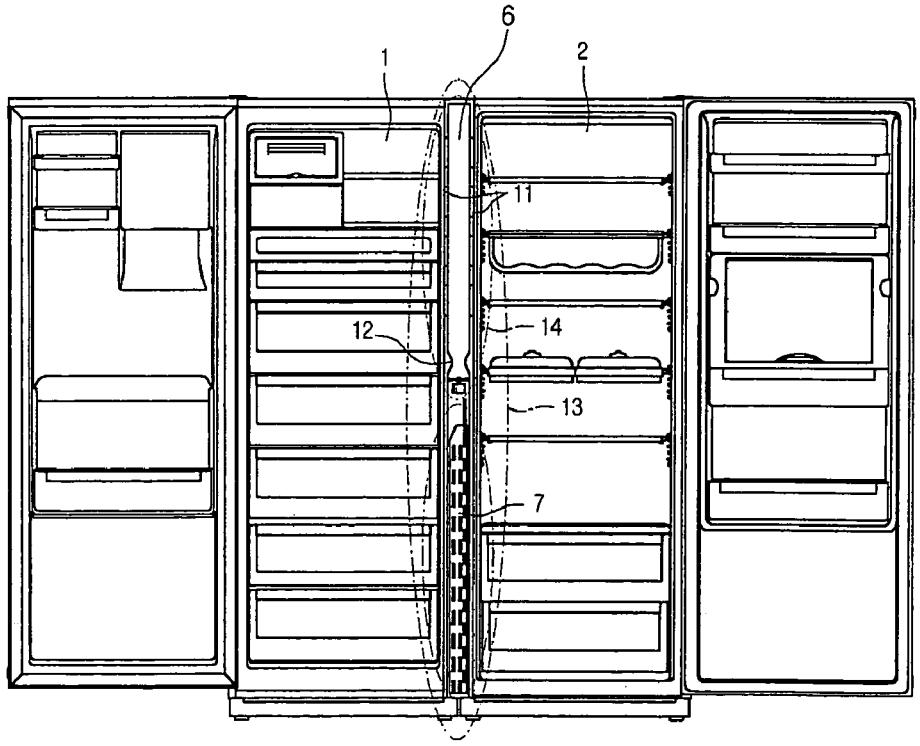
FIG. 8 shows a second embodiment of a refrigerator having the evaporator, the blow fan and the cooling air outlet of FIG. 5.

FIG. 8 shows a second embodiment of a refrigerator having the evaporator, the blow fan and the cooling air outlet of FIG. 5. The evaporator can be provided on a lower portion of the compartment.

Figure 9:
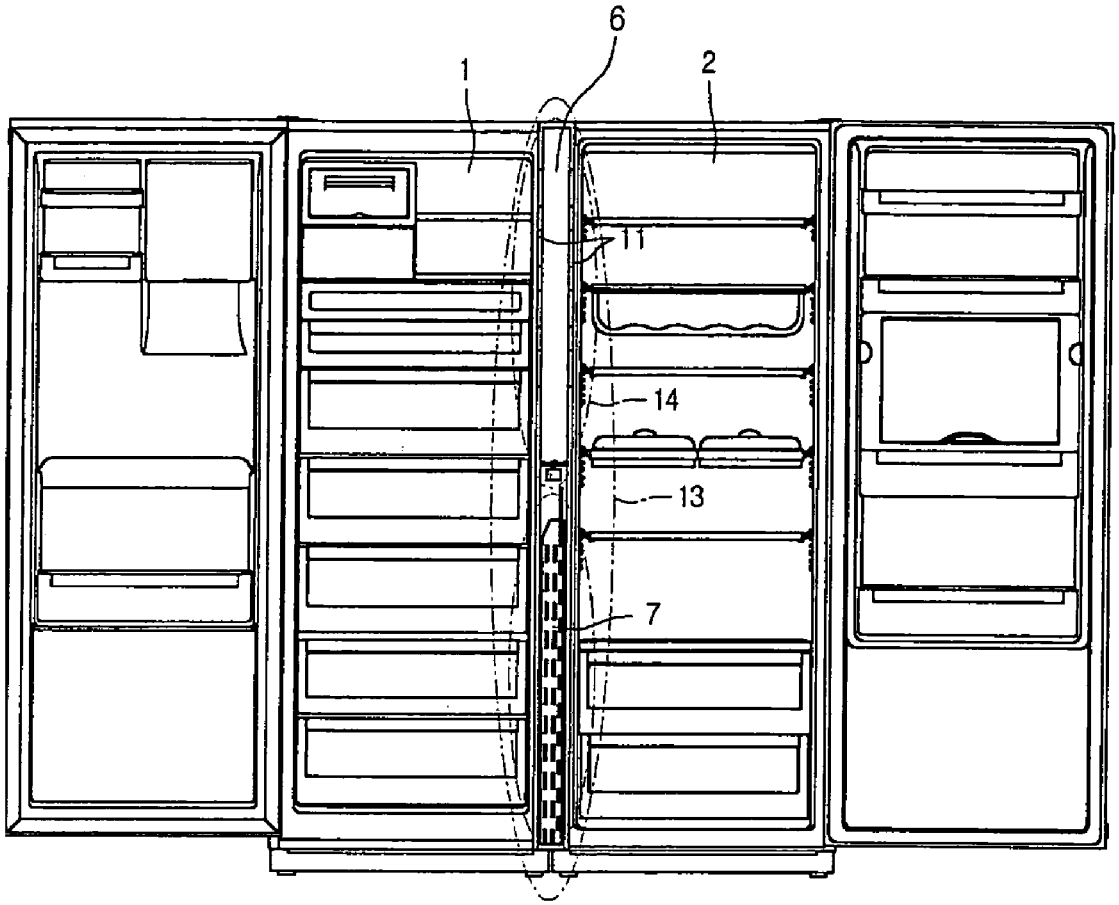
FIG. 9 shows a third embodiment of a refrigerator having the evaporator, the blow fan and the cooling air outlet of FIG. 5.

FIG. 9 shows a third embodiment of a refrigerator having the evaporator, the blow fan and the cooling air outlet of FIG. 5. The path between the side walls, as the passage of the cooling air, for transmitting the cooling air passing through the blow fan to the cooling air outlet is uniformly formed.

As can be seen from the foregoing refrigerator composed of the freezing chamber and the cooling chamber, the evaporator unit is provided in the means for partitioning the freezing chamber and the cooling chamber from each other, so that it is possible to maximize availability of the received space as the efficient volume of the refrigerator. Eventually, the utility of the refrigerator is increased compared to that of the same size, and simultaneously it is possible to increase convenience of the user.

While the preferred embodiments of the present invention have been described, the present invention may be employed to various changes, modifications and their equivalents. Thus, it is apparent that the embodiments of the present invention can be properly modified and applied in the same manner.

For example, in the case that the freezing chamber and the cooling chamber are partitioned up and down, a space between them may be provided with the evaporator unit and the means for transmitting and controlling the cooling air.

Therefore, it should be understood that the above-described embodiments are not limited by any of the details of the foregoing description, but rather should be construed broadly within its spirit and scope as defined in the appended claims.

What is claimed is:

1. A refrigerator comprising:

freezing and cooling chambers, each of the freezing and cooling chambers configured to provide at least one space for receiving an article;

an evaporator;

a cooling air transmitter that transmits cooling air that has been heat-exchanged with the evaporator into each of the freezing and cooling chambers, the transmitter comprising a blower fan;

a partition provided to separate the freezing and cooling chambers, the partition being configured to define a predetermined space therein and to provide cooling air outlets to the freezing and cooling chambers, the evaporator and the blower fan being positioned within the predetermined space provided within the partition, the predetermined space defining a cooling air passage, a portion of the cooling air passage defined by side walls of the partition and above the blower motor being narrowed to increase a velocity of a stream of cooling air output by the blower fan to the freezing and cooling chambers;

a diverter positioned at a top of the cooling air passage to direct the cooling air into the freezing and cooling chambers, the diverter having a vertex facing the blower fan;

the evaporator, the blower fan, and the cooling air outlets from the predetermined space to the freezing and cooling chambers being arranged in this order from a lower portion of the predetermined space and the cooling air outlets to the freezing and cooling chambers being symmetrically arranged about a rotational axis of the blower fan.

2. The refrigerator as recited in claim 1, wherein the partition includes a damper at the cooling air outlet to at least one of the freezing and cooling chambers.

3. The refrigerator as recited in claim 1, further including a guide configured to guide the cooling air output by the blower fan towards at least one of the cooling air outlets.

4. The refrigerator as recited in claim 1, wherein cooling air outlets to the freezing and cooling chambers are provided adjacent to each other.

5. The refrigerator as recited in claim 1, wherein the cooling air outlet of the freezer and cooling chambers are positioned at a substantially same elevation of the partition.

6. The refrigerator as recited in claim 1, wherein the cooling air outlets are provided in opposing sidewalls of the partition.

7. The refrigerator as recited in claim 1, wherein the predetermined space extends linearly from the evaporator towards an outlet to the freezing and cooling chambers.

8. The refrigerator as recited in claim 1, wherein the evaporator is mounted at a middle portion of the predetermined space.

9. The refrigerator as recited in claim 1, wherein the evaporator is mounted at a lower portion of the predetermined space.

10. The refrigerator as recited in claim 1, wherein the evaporator, the blower and the cooling air outlet are linearly arranged within the predetermined space.

11. The refrigerator as recited in claim 1, wherein a rotational axis of the blower fan extends in a direction corresponding to a major dimension of the predetermined space.

12. A refrigerator comprising:

freezing and cooling chambers, each of the freezing and cooling chambers configured to provide at least one closable space for receiving an article, said freezing and cooling chambers being horizontally spaced and proximate to each other;

a partition provided between and separating the freezing and cooling chambers, the partition being configured to define a predetermined space therein and to provide cooling air outlets to the freezing and cooling chambers, the partition extending substantially vertically;

an evaporator;

a blower fan configured to transmit cooling air that has been heat exchanged by the evaporator into each of the freezing and cooling chambers;

a diverter positioned at a top of the predetermined space to direct the cooling air into the freezing and cooling chambers, the diverted having a vertex facing the blower fan;

the evaporator, the blower fan and the cooling air outlets from the predetermined space to the freezing and cooling chambers being positioned within the predetermined space defined by the partition and being arranged in this order from a lower portion of the predetermined space;

the cooling air outlets from the predetermined space to the freezing and cooling chambers being positioned at substantially a same elevation and on opposite sidewalls of the partition; and the predetermined space within the partition comprising a narrowed portion between the blower fan and the outlets to change a velocity of the cooling air output to the freezing and cooling chambers, wherein the narrowed portion and the cooling air outlets to the freezing and cooling chambers are symmetrically arranged about a rotational axis of the blower fan.

13. The refrigerator as recited in claim 12, wherein the partition includes a damper at the cooling air outlets to the freezing and cooling chambers.

14. The refrigerator as recited in claim 12, wherein the evaporator is mounted at a middle portion of the predetermined space.

15. The refrigerator as recited in claim 12, wherein the evaporator is mounted at a lower portion of the predetermined space.

16. The refrigerator as recited in claim 12, wherein the evaporator, the blower fan and the cooling air outlet are linearly arranged within the predetermined space.

17. The refrigerator as recited in claim 12, further including a guide configured to guide the cooling air output by the blower fan towards at least one of the cooling air outlets.

18. The refrigerator as recited in claim 12, wherein the predetermined space extends linearly from the evaporator towards an outlet to the freezing and cooling chambers.

19. The refrigerator as recited in claim 12, wherein a rotational axis of the blower fan extends in a direction corresponding to a major dimension of the predetermined space.

* * * * *